United States Patent [19]

Stedman

[11] 4,312,427

[45] Jan. 26, 1982

[54] EXTRA LIFT MAST FOR LIFT TRUCKS

[75] Inventor: Robert N. Stedman, Chillicothe, Ill.

[73] Assignee: Caterpillar Tractor Co., Peoria, Ill.

[21] Appl. No.: 195,718

[22] PCT Filed: Mar. 10, 1980

[86] PCT No.: PCT/US80/00248

§ 371 Date: Mar. 10, 1980

§ 102(e) Date: Mar. 10, 1980

[87] PCT Pub. No.: WO81/02566

PCT Pub. Date: Sep. 17, 1981

[51] Int. Cl.[3] ..... B66B 9/20

[52] U.S. Cl. ..... 187/9 E; 414/631

[58] Field of Search ..... 187/9 R, 9 E, 95; 414/629, 631, 641

[56] References Cited

U.S. PATENT DOCUMENTS

| | | | |
|---|---|---|---|
| 2,456,320 | 12/1948 | Repke | 414/631 |
| 2,685,976 | 8/1954 | Ulinski | 414/629 |
| 2,821,264 | 1/1958 | Ulinski | 187/9 E |
| 2,877,868 | 3/1959 | Gunning et al. | 187/9 R |
| 3,433,325 | 3/1969 | McIntosh | 187/9 E |
| 4,030,568 | 6/1977 | Heinold | 187/9 E |
| 4,124,104 | 11/1978 | Yarris | 187/9 E |
| 4,191,276 | 3/1980 | Farmer | 187/9 E |

*Primary Examiner*—David A. Scherbel
*Assistant Examiner*—Kenneth Noland
*Attorney, Agent, or Firm*—Phillips, Moore, Weissenberger, Lempio & Majestic

[57] ABSTRACT

Free-lift of a lift truck carriage is desirable without extension of the uprights, along with the capability to extend the carriage above the uprights, all while retaining clear forward vision and a rigid mast structure. Herein, relatively movable mast members (14*a*,14*b*) are shorter than relatively fixed mast members (12*a*,12*b*), the sheaves (28*a*,28*b*) are affixed to the movable members (14*a*,14*b*), the chains (30*a*,30*b*) are attached to the carriage (16) over the sheaves (28*a*, 28*b*) and to the relatively fixed members (12*a*,12*b*), while the jacks (24*a*,24*b*) act between the relatively fixed (12*a*,12*b*) and movable (14*a*,14*a*) members. Slide bars (44*a*,44*b*) are movably mounted to the relatively movable members (14*a*,14*b*) and to the carriage (16). A structure (50) is provided for preventing further linear movement of the slide bars (44*a*,44*b*) relative to the relatively movable mast members (14*a*,14*b*) while allowing further linear movement of the carriage (16) relative to the slide bars (44*a*,44*b*), as the jacks (24*a*,24*b*) extending beyond a selected length.

6 Claims, 12 Drawing Figures

EXTRA LIFT MAST FOR LIFT TRUCKS

TECHNICAL FIELD

This invention relates generally to an extensible assembly such as those used on lift trucks. More particularly, the present invention relates to a mast assembly which provides maximum operator visibility, through the use of spaced apart lift cylinders, while concurrently providing substantially free-lift of the carriage without extension of the mast uprights, and the capability for moving a lift truck carriage an extended distance above floor level.

BACKGROUND ART

Most commercial lift trucks have mast supported carriages which are lifted by means of hydraulic jacks, chain drives, or combinations of both systems. One problem often presented by such lift trucks is that of limited operator visibility. The usually required centralized placement of the mast assembly lift cylinder, relative to the supporting mast, often blocks the vision of an operator located in the cab or operator station of the lift truck.

Another problem presented by such lift trucks is that of excessive unextended mast height. Lift trucks are often required to operate in areas where the ceiling is intermittently low. This requires that such vehicles present a relatively low profile when moving from one load space to another. However, by providing a relatively short fixed mast assembly to permit maneuverability in low ceiling areas, the maximum lift height of the mast assembly may be unduly limited.

Some attempts have been made to address the free lift problem while retaining forward visibility. One solution is set out in U.S. Pat. No. 4,030,568, issued June 21, 1977 to Lloyd K. Heinold. A pair of conventional hydraulic jacks are mounted, one slightly outboard of each of the outer mast members of the mast assembly. Sheaves are mounted to the rods of the jacks, with chains being reeved over the sheaves and being attached to the fixed uprights and the carriage. As the rods extend, the carriage proceeds upward in free-lift operation (operation wherein the carriage moves upward but the overall height of the mast assembly is not extended). Free lift is advantageous in that a load may be picked up and maneuvered without increasing the overall height of the vehicle. This is most important in low ceilinged buildings. After the rods have extended the free-lift distance, they engage the movable mast members whereupon the carriage proceeds upwardly with the movable mast members to a height above that of the fixed uprights. However, not as much height is attained as is desirable.

With such mast assemblies as are disclosed in the Heinold patent no cross-bracing is present between the cylinder rods during free lift operation and no connection exists between the rods and the uprights. During free lift, the overall assembly is, thus, not cross-braced. Thus, during free lift, the unbraced jacks are subjected to the weight carried by the carriage as well as to accidental jolts. Because of the lack of cross-bracing, this can lead to misalignment of the jacks with the movable mast whereby the engagement of the rods with the movable mast may be impaired, or in extreme cases even prevented. Also, the jacks are limited in length so as to allow free lift operation. This creates a limit on the overall height to which the carriage can be raised.

It would be desirable to provide a high visibility mast assembly which retained the advantages of the apparatus disclosed in the Heinold patent but which was fully braced during free lift operation and thus was not subject to possible alignment problems, and which would allow lifting the carriage to above the height attainable with the Heinhold apparatus.

The present invention is directed to overcoming one or more of the problems as set forth above.

DISCLOSURE OF INVENTION

According to one embodiment of the present invention, an improvement is provided in an extensible assembly having first and second spaced apart pairs of parallel adjacent uprights and having a carriage. The second pair of uprights is linearly movably mounted to the first pair of uprights and the carriage is linearly movably mounted to the second pair of uprights. In such an assembly a pair of extensible jacks are provided, adjacent and generally parallel to the first and second pairs of uprights. A guide structure is connected to one end of the second pair and moves with the second pair on extension and contraction of the jacks, and a flexible tension member is connected to the first pair of spaced apart members, passes over the guide structure and is connected to the carriage. The improvement comprises making the second pair of uprights shorter than the first pair, affixing the guide structure to the second pair and securely connecting the jacks to the first and second pairs of uprights.

Further, the previously described extensible assembly is improved by including a pair of members, movably mounted to the second pair of uprights and movably mounted to the carriage, and by providing means for preventing further linear movement of the pair of members relative to the second pair of uprights while allowing further linear movement of the carriage relative to the pair of members, in response to the jacks extending beyond a selected length.

Through utilizing an improvement as set out above in a mast assembly for a lift truck, with the jacks located closely adjacent the mast members, high visibility is retained along with a predetermined amount of free-lift of the carriage. Further, the total lift height attainable with the mast assembly is at least as great as that attainable with prior art apparatus. Still further, the assembly is rigidly connected together during free lift operation, thus, increasing structural strength and virtually eliminating alignment problems.

BEST MODE FOR CARRYING OUT THE INVENTION

It should be noted that while the foregoing and following description and the drawings illustrate the invention in connection with a mast for lift trucks such description is not meant to be limiting, since other uses for the improvement of the present invention will also be apparent to those skilled in the art.

Figure 1:
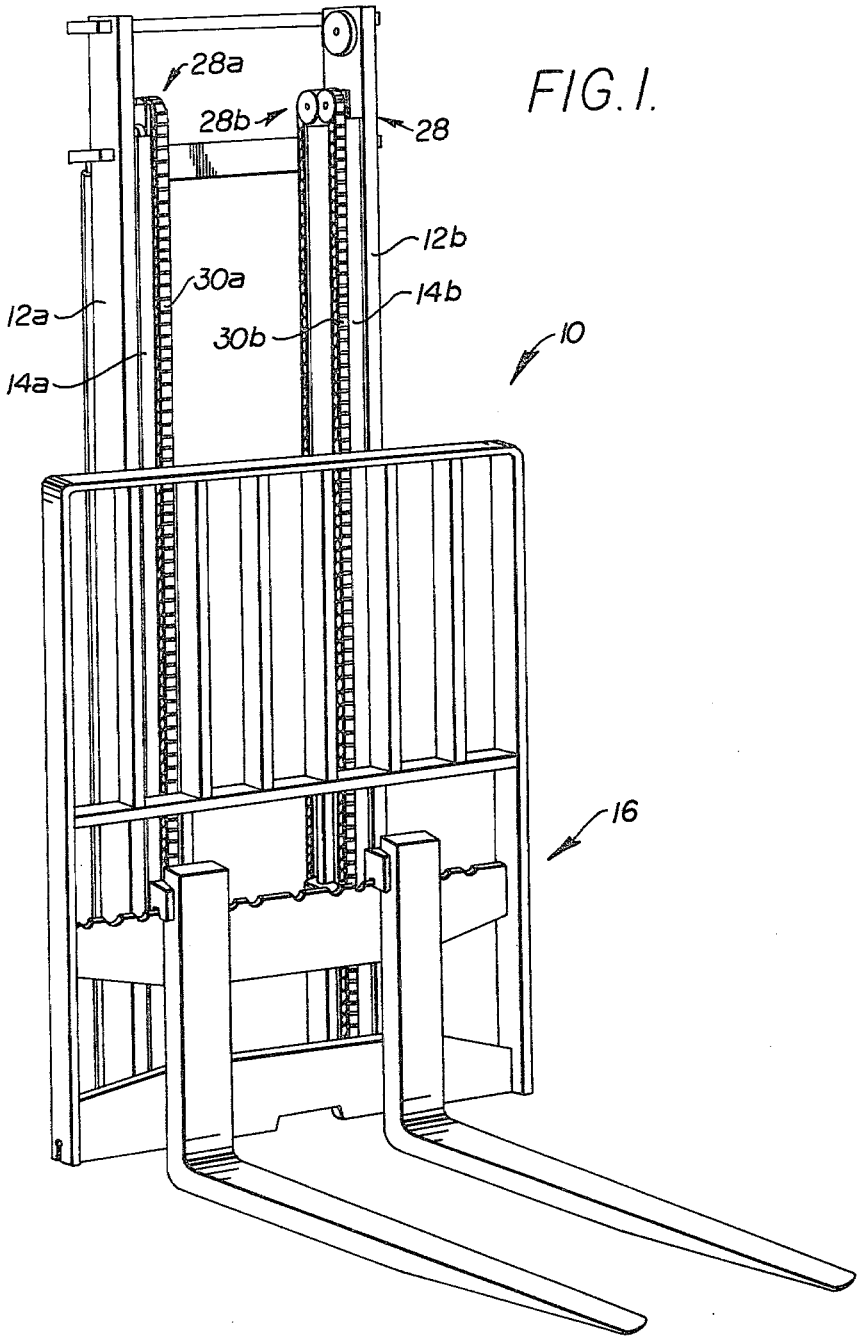
FIG. 1 is an isometric view of a mast assembly in accordance with an embodiment of the present invention.

A mast assembly 10 in accordance with the present invention is shown in FIG. 1. Such an assembly might be mounted to an industrial lift truck, but as such does not form a part of the present invention is it not illustrated. As will be seen from FIG. 1, the mast assembly 10 is mounted in a generally vertical plane. Generally, such mast assemblies will be tiltable forwardly or rearwardly relative to the frame of an industrial lift truck (not shown) or the like.

The mast assembly 10 includes a pair of first generally fixed mast members or uprights **12*a*,12*b* in which a pair of second relatively movable mast members or uprights 14*a*,14*b* are disposed. A carriage 16 is linearly movably mounted to the pair of movable mast members 14*a*,14*b* by conventional rollers as seen, for example, in FIG. 2. The relatively fixed mast members 12*a*,12*b* are tied together by conventional tie bars 18 and 20, the tie bar 18 being at upper end portions 21*a*,21*b* of the relatively fixed mast members 12*a*,12*b*. Similarly, the relatively movable mast members 14*a*,14*b* are tied together by a conventional tie bar 22 and by an additional tie bar 23 near their bottom ends. This structure is shown most clearly, perhaps, in FIGS. 2 and 3**.

Figure 3:
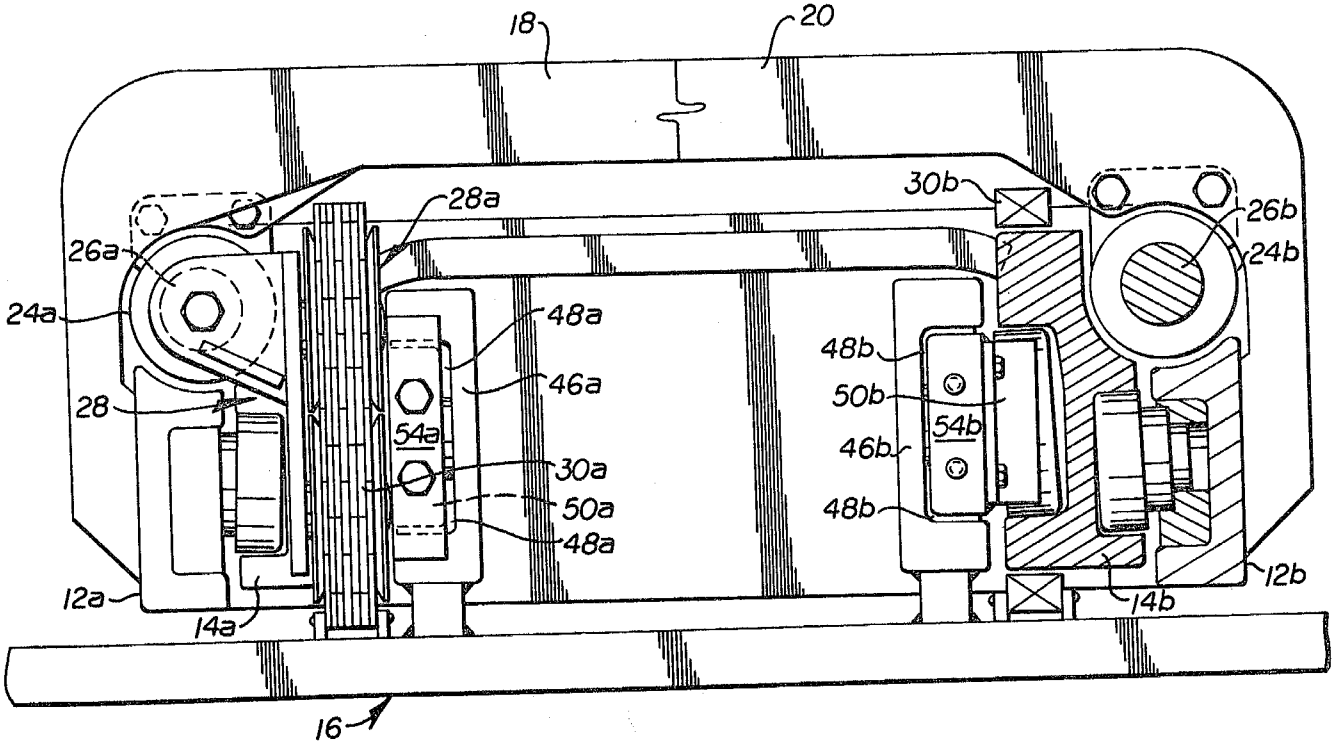
FIG. 3 is a view taken along the line III—III of FIG. 2.

As will be seen from FIG. 3, the relatively fixed mast members **12*a*,12*b* are of conventional channel construction as are the relatively movable mast members 14*a*,14*b***, with the respective channels serving for receiving conventional rollers.

Figure 2:
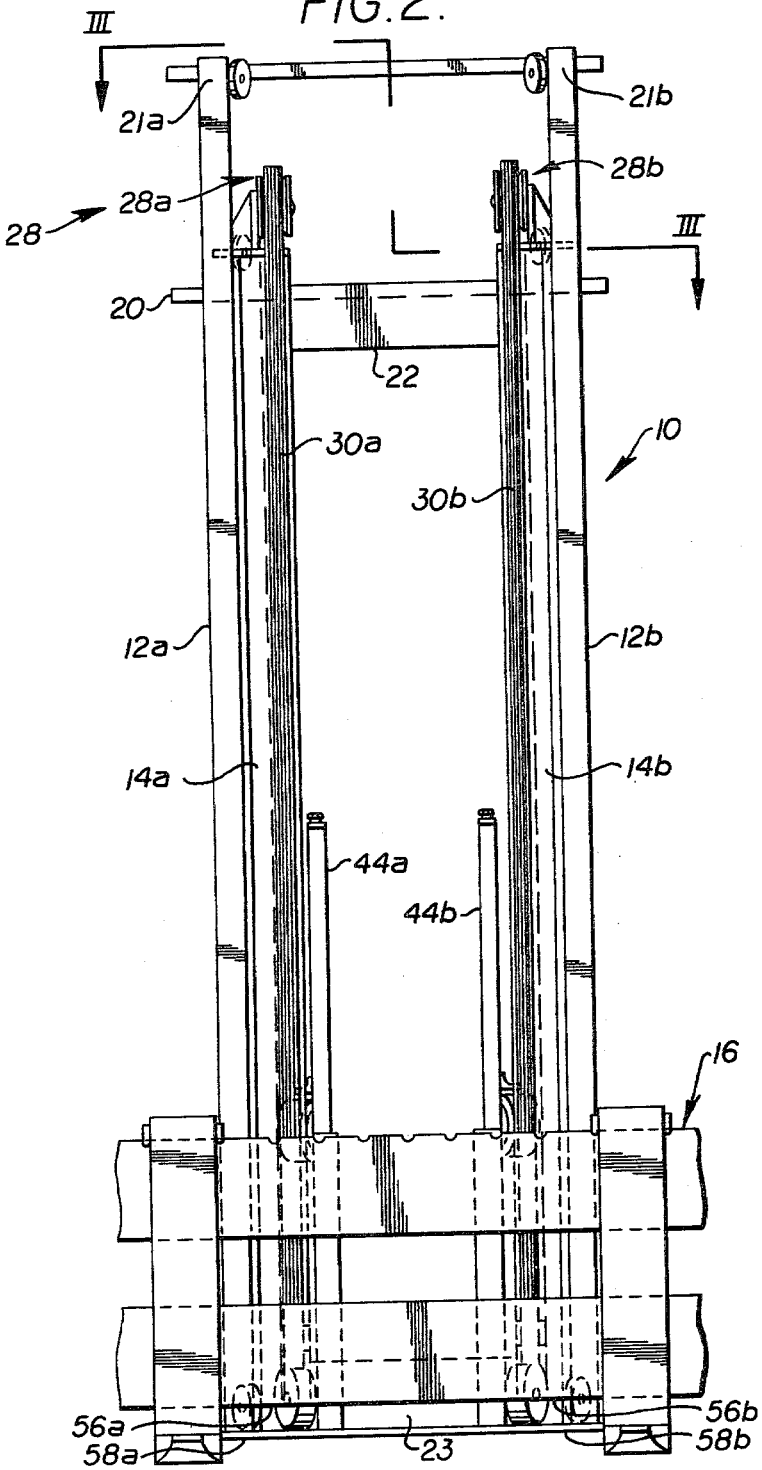
FIG. 2 is a front view of the assembly shown in FIG. 1.

A pair of extensible hydraulic jacks **24*a*,24*b* having rods 26*a*,26*b* are located adjacent and generally parallel to the mast members 12*a*,12*b* and 14*a*,14*b*. A guide structure 28 is provided, in the embodiment illustrated a pair of sheaves structures 28*a*,28*b*, both of which are seen in FIGS. 1 and 2 (each sheave structure including two sheaves), and one of which, namely 28*a*, is shown in FIG. 3. The sheave structures 28*a*,28*b* are connected to the movable mast members 14*a*,14*b* to move linearly parallel to the mast members 12*a*,12*b* on extension and retraction of the jacks 24*a*,24*b*. A pair of flexible tension members, in the embodiment illustrated a pair of chains 30*a*,30*b*, are trained or reeved over the sheaves 28*a*,28*b***.

Figure 4:
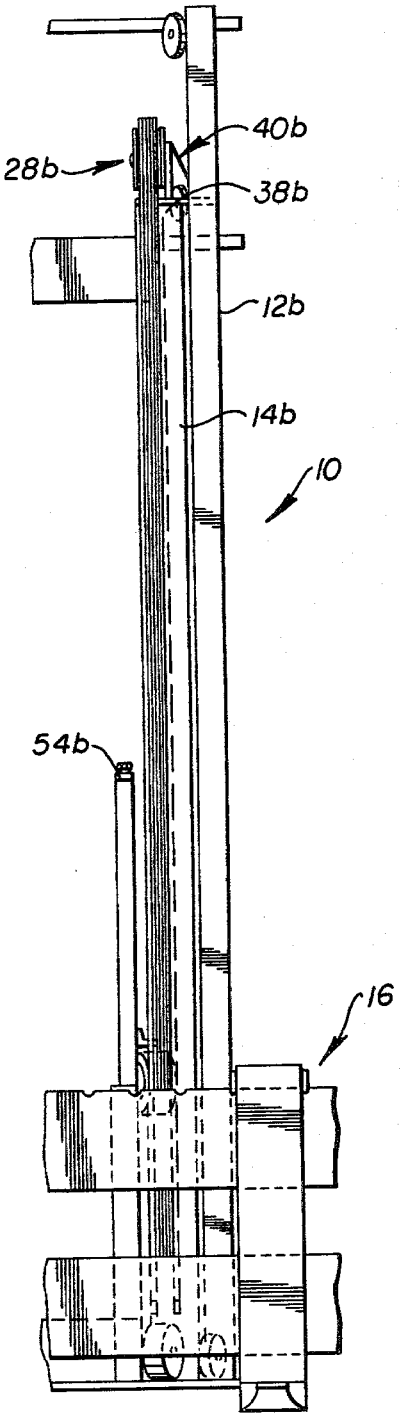
FIG. 4 is a partial front view of approximately one-half of the mast assembly of FIG. 1 with the carriage and uprights in its fully lowered position.
Figure 5:
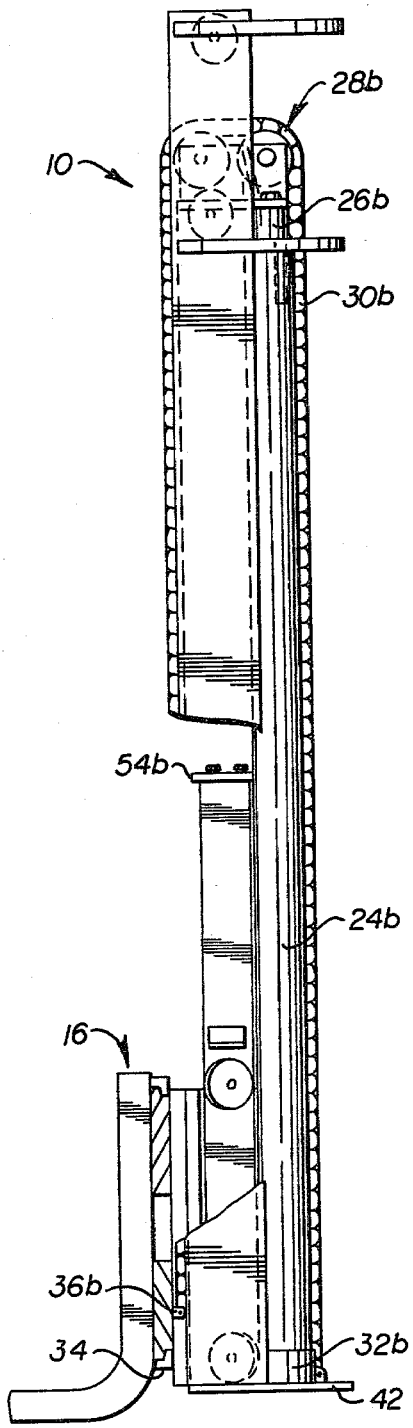
FIG. 5 is a side view of the embodiment shown in FIG. 1 with the carriage in its fully lowered position.

Since the assembly 10 is symmetrical, FIGS. 4–12 shown only the right hand side of the assembly 10 shown in FIGS. 1–3, with the designations "a" and "b" being used to refer to left hand side and right hand side components which are otherwise identical. The chains **30*a*,30*b* are mounted to the respective relatively fixed mast members 12*a*,12*b*, as at an anchor 32*b* in which the jack 24*b* fits (see, for example, FIG. 5). After passing over the respective sheave structure 28*b*, the chain 30*b* is attached adjacent its other end to the carriage 16 adjacent a bottom 34 thereof as indicated in FIG. 5 at 36*b***.

Adverting now to FIGS. 4 and 5, it will be seen that the movable mast member **14*b* is shorter in length than the fixed mast member 12*b*. It will be further noted that the sheave structure 28*b* is affixed to the movable mast member 14*b* at an upper portion 38*b* thereof in any suitable manner. Briefly, a bracket 40*b* serves to support the sheave structure 28*b*, and to affix the sheave structure 28*b* to the movable mast member 14*b*. As will be seen in FIG. 5, the jack 24*b* is connected by anchor 32*b* to a baseplate 42, which connects together the relatively fixed mast members 12*a*,12*b* (see FIG. 3) at their lower ends. The jack 24*b* is also connected at the rod 26*b* thereof to the movable mast member 14*b*. Thus, as the rod 26*b* of the jack 24*b* is extending, not only is the movable mast member 14*b* moving upwardly, but also the carriage 16 is being moved upwardly via the chain 30*b* which is trained over the sheave structure 28*b*. The carriage 16 and the relatively movable mast members 14*a*,14*b* move upwardly from the position illustrated in FIGS. 4 and 5 to that illustrated in FIGS. 6 and 7, during which movement free-lift of the carriage is provided without extension of the mast assembly 10**.

Figure 6:
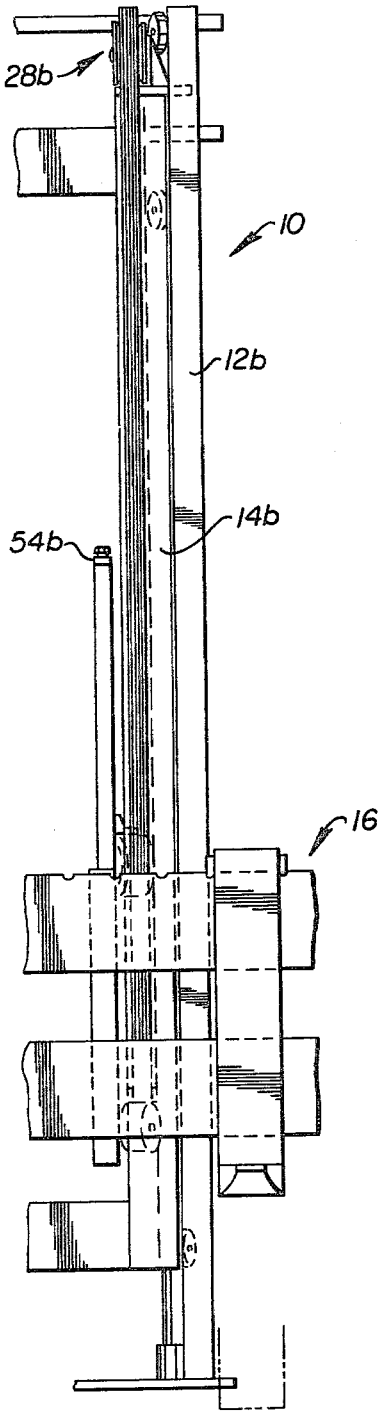
FIG. 6 is a view similar to FIG. 4, but with the carriage at the top of its free-lift movement.
Figure 7:
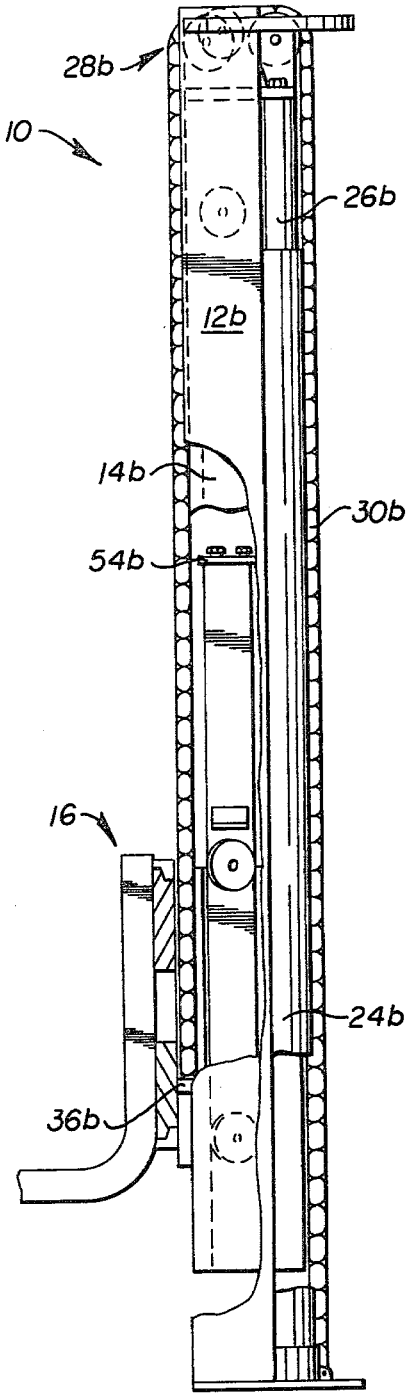
FIG. 7 is a view similar to FIG. 5, but with the carriage at the top of its free-lift position.
Figure 8:
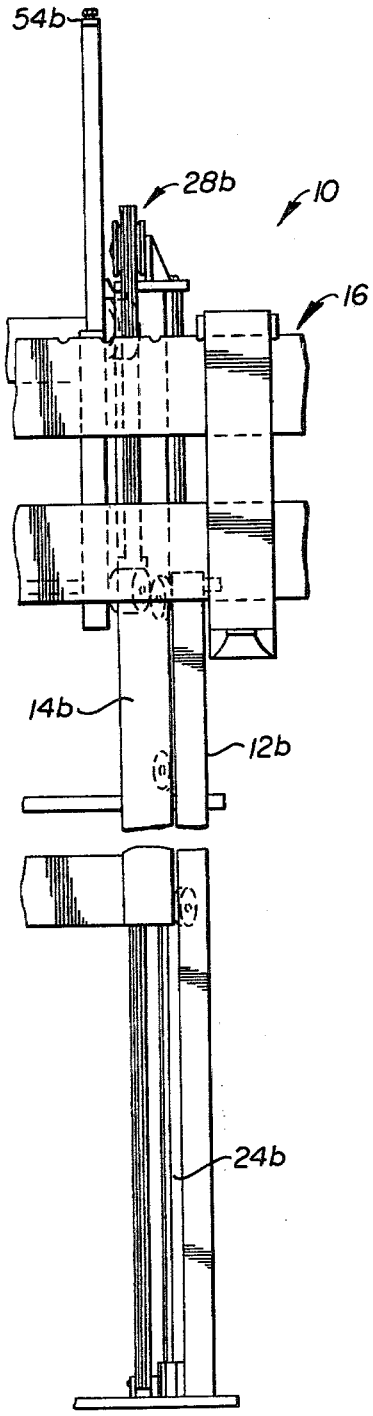
FIG. 8 is a view similar to FIG. 4, but with the carriage adjacent the top of the movable upright.
Figure 9:
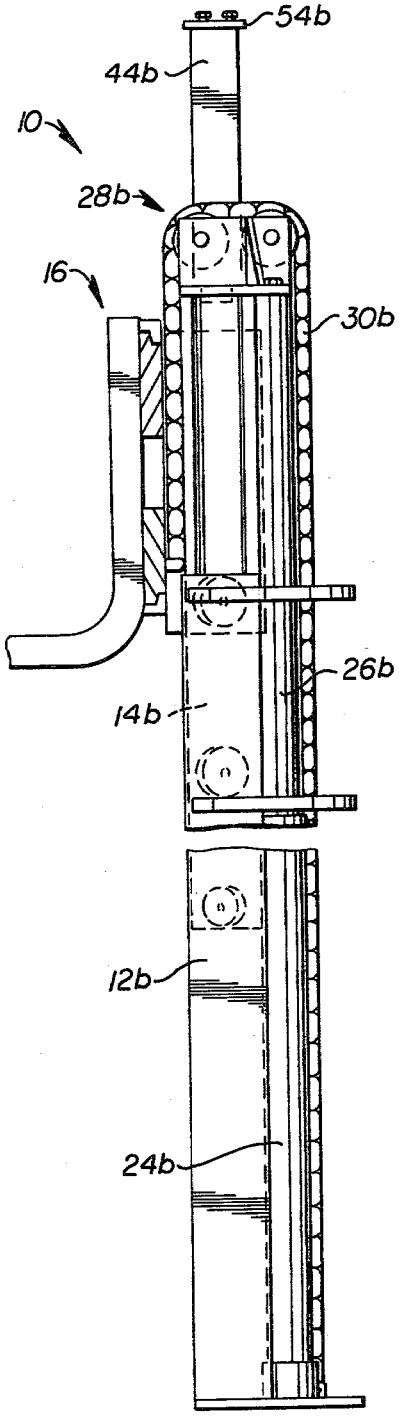
FIG. 9 is a view similar to FIG. 5, but with the carriage adjacent the top of the movable upright.
Figure 10:
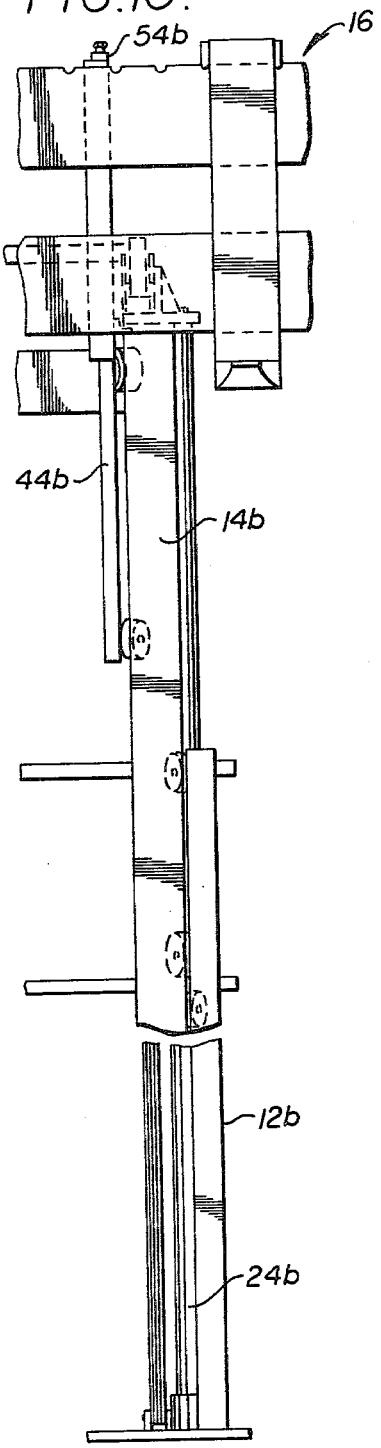
FIG. 10 is a view similar to FIG. 4, but with the carriage at its highest extension above the movable upright.
Figure 11:
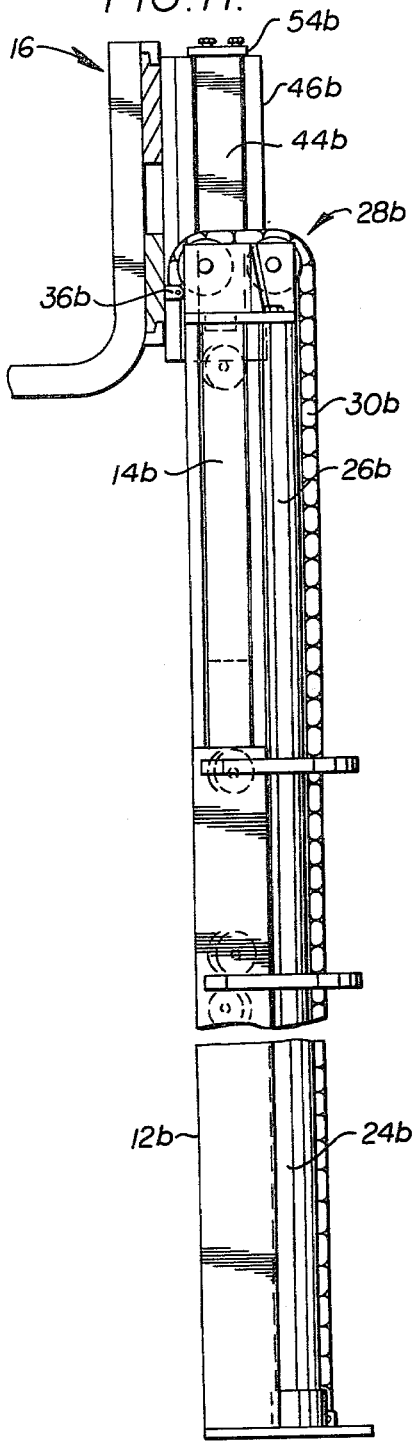
FIG. 11 is a view similar to FIG. 5, but with the carriage at its highest extension above the movable upright.

As the jacks **24*a*,24*b* extend further, as from the position shown in FIGS. 6 and 7 to that shown in FIGS. 8 and 9, free-lift of the carriage 16 no longer is occuring, since the carriage 16, as well as the relatively movable member 14*b*, extends above the upper end 21*b* of the relatively fixed mast member 12*b***.

FIGS. 8 and 9 indicate the maximum extension of the mast assembly 10 in the absence of the structure which allows high lift. In accordance with the preferred embodiment of the present invention, an even higher movement of the carriage 16 is possible as will be most apparent from comparison of FIGS. 8 and 9 with FIGS. 10 and 11, with reference also to FIGS. 2 and 3 for an understanding of the symmetry of the structure. Briefly, a pair of members or slide bars **44*a*,44*b*, are movably mounted to the carriage 16 as via U-shaped channel brackets 46*a*,46*b* which extend rearwardly from the carriage 16 (See FIG. 3). Generally, bearing means such as L-shaped bearings 48*a*,48*b* are fastened within the U-shaped brackets 46*a*,46*b* to provide sliding contact between the slide bars 44*a*,44*b* and the carriage 16. Normally, there is sufficient frictional contact between the bearings 48*a*,48*b* and the slide bars 44*a*,44*b* so that the slide bars 44*a*,44*b* are carried upwardly with the carriage 16. Such bearings 48*a*,48*b* can be made of any suitable material, for example, they may be made of ultrahigh molecular weight polyethylene material which has the desired lubricity and toughness. As the carriage 16 moves upwardly, from the position in FIGS. 4 and 5 to the position in FIGS. 8 and 9, the slide bars 44*a*,44*b* move upwardly with the carriage 16 and thereby move upwardly relative to the stationary mast members 12,12*b***.

Figure 12:
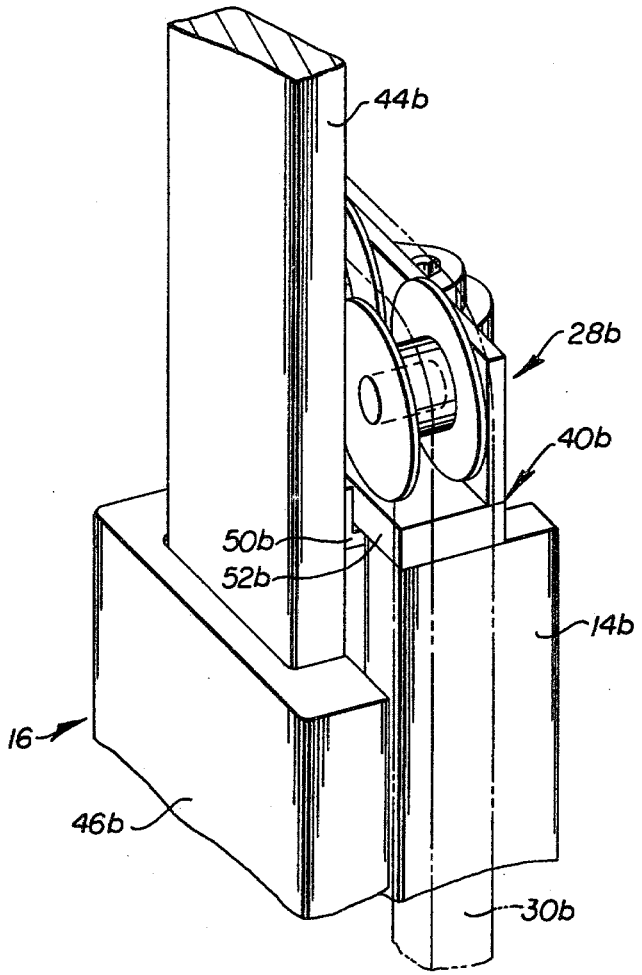
FIG. 12 is a partial perspective view illustrating the detail in the illustrated embodiment which allows the carriage to move upwardly to the position illustrated in FIGS. 10 and 11.

Referring to FIGS. 3, 8 and 12, it will be seen that stops **50*a*,50*b* extend from the slide bars 44*a*,44*b* towards the relatively movable mast members 14*a*,14*b*. When the carriage 16, and with it the slide bars 44*a*,44*b*, has been moved upwardly to the position shown in FIGS. 8 and 9, the stops 50***a*,50*b* contact a plate 52*a*,52*b*, which may be part of the bracket 40*a*,40*b*, and engage therewith. This prevents further upward movement of the slide bars 44*a*,44*b*. However, since the carriage 16 is movably mounted to the slide bars 44*a*,44*b* (for movement relative thereto), the chains 30*a*,30*b* cause the carriage 16 to move upwardly along the slide bars 44*a*,44*b*. This allows the carriage 16 to move upwardly to the position shown in FIGS. 10 and 11. At that position, the chains 30*a*,30*b* cannot raise the carriage 16 any higher since the point of attachment of the chains 30*a*,30*b* to the carriage 16, namely the points 36*a*,36*b*, are at the same level as are the sheaves 28*a*,28*b*. Since the movable mast members 14*a*,14*b* are shorter than the fixed mast members 12*a*,12*b*, the jacks 24*a*,24*b* can be of a length selected to give maximum lift to the carriage 16.

The slide bars 44*a*,44*b* have an additional stop 54*a*,54*b* which engages the top end of the carriage 16 so as to prevent the carriage 16 from moving too high thereon. This is not of particular use in the positioning shown in FIGS. 10 and 11, but is instead useful in the event the slide bars 44*a* and 44*b* should become somehow jammed when in a lower position. In such a situation, the carriage 16 is prevented from being moved upwardly and off of the slide bars 44*a*,44*b*.

It will be seen that the stops 50*a*,50*b*, along with the plates 52*a*,52*b*, serve as means 50 for preventing further linear movement of the slide bars 44*a*,44*b* relative to the relatively movable mast members 14*a*,14*b* while allowing further linear movement of the carriage 16 relative to the slide bars 44*a*,44*b* (and relative to the movable mast members 14*a*,14*b*), in response to the jacks 24*a*,24*b* extending beyond a selected length, namely the length which the jacks 24*a*,24*b* have attained in FIGS. 8 and 9.

As will be noted from FIGS. 4 and 5, the chains 30*a*,30*b* are selected to be of a length to provide desired lift height and to substantially align the lower end portion 34 of the carriage 16 and a lower end portion 56*a*,56*b* (See FIG. 2) of the relatively movable mast members 14*a*,14*b* generally with the lower end portion 58*a*,58*b* (See FIG. 2) of the relatively fixed mast members 12*a*,12*b* on retraction of the jacks 24*a*,24*b*. This is desirable in the lift truck mast assembly 10 so as to allow proper positioning of the carriage 16 for taking up and discharging a load at ground level.

It should be noted that the slide bar arrangement 44*a*,44*b*, in conjunction with the stops 50*a*,50*b* for engagement with the plates 52*a*,52*b*, is in and of itself useful to extend the height to which a carriage 16 can be raised above floor level. That is, extra height extension is thereby obtained. It should also be noted that, in essence, the slide bars 44*a*,44*b* in the preferred embodiment of the invention serve to allow the carriage 16 to travel to the same height as it would if the movable members 14*a*,14*b* were the same length as the relatively fixed members 12*a*,12*b* whereby the carriage 16 could then slide to the top of the (now longer) relatively movable members 14*a*,14*b*. Yet further, it should be noted that since the jacks 24*a*,24*b* are positioned adjacent the mast members 12*a*,12*b*,14*a*,14*b*, an unobstructed view is provided through the mast assembly 10 for an operator who is sitting behind it.

INDUSTRIAL APPLICABILITY

The improvement of the present invention is particularly useful with a mast assembly 10 which is mounted on the fore section of a lift truck. The assembly 10 is of a minimum height when retracted so as to allow it to be easily maneuvered in relatively low ceiling areas, yet the height of the mast assembly 10 can be significantly extended upwardly to provide needed high lift operation. Further, free-lift of the carriage is provided to allow loads to be lifted to at least a travel height (the height of the carriage being shown in FIGS. 6 and 7) in low ceilinged areas.

Other aspects, objectives, and advantages of this invention can be obtained from a study of the drawings, the disclosure and the appended claims.

I claim:

1. In an extensible mast assembly (10) having first (12*a*, 12*b*) and second (14*a*,14*b*) pairs of parallel spaced apart uprights, and a carriage assembly (16), each of said second pairs (14*a*,14*b*) of spaced apart uprights being connected to a respective one of said first pair (12*a*,12*b*) of spaced apart uprights, said second pair (14*a*,14*b*) of spaced apart uprights being linearly movable relative to said first pair (12*a*,12*b*) said carriage assembly (16) being connected to and substantially linearly movable relative to said second pair (14*a*,14*b*) of spaced apart uprights, a pair of jacks (24*a*,24*b*), each being positioned adjacent and substantially parallel to respective ones of said first (12*a*,12*b*) and second (14*a*,14*b*) pairs of spaced apart uprights, each of said second uprights (14*a*,14*b*) having an upper end portion (38*a*,38*b*) and each of said first uprights (12,12*b*) having an upper end (21*a*,21*b*) and a lower end portion (58*a*,58*b*), each of said jacks (24*a*,24*b*) being connected to the upper end portion (38*a* and 38*b*) of a respective one of said second spaced apart uprights (14*a*,14*b*) and to the lower end portion (58*a*,58*b*) of a respective one of said first pair (12*a*,12*b*) of spaced apart uprights, said jacks (24*a*,24*b*) being extensible for moving said second pair (14*a*,14*b*) of uprights relative to said first pair (14*a*,14*b*), and a pair of flexible tension members (30*a*,30*b*), each being connected to a respective one of said first uprights (12*a*,12*b*) and said carriage assembly (16), the improvement comprising:

a pair of guide members (28*a*,28*b*), each being affixed to the upper end portion (38*a* and 38*b*) of a respective one of said second uprights (14*a*,14*b*), each of said guide members (28*a*,28*b*) being in engagement with a respective one of said flexible tension members (30*a*,30*b*) and being movable with and in response to movement of said second pair (14*a*,14*b*) of uprights;

said second pair (14*a*,14*b*) of spaced apart uprights being of a length shorter than said first pair (12*a*,12*b*) of spaced apart uprights;

said carriage assembly (16) being movable to a preselected elevated position in response to the upper end portion (38*a*,38*b*) of said second pair (4*a*,14*b*) of spaced apart uprights being moved to an elevated location less than or equal to the upper end (21*a*,21*b*) of said first pair (12*a*,12*b*) of spaced apart uprights.

2. In an extensible mast assembly (10) having a first pair (12*a*, 12*b*) of generally parallel spaced apart uprights and a second pair (14*a*, 14*b*) of generally parallel spaced apart uprights, each respective upright (12*a*, 12*b*) of said first pair (12*a*, 12*b*) being positioned adjacent and mounted for generally parallel linear movement relative to a respective upright (14*a*, 14*b*) of said second pair (14*a*, 14*b*); a carriage (16) mounted for generally parallel movement relative to said first pair (12*a*, 12*b*); a pair (24*a*, 24*b*) of extensible jacks (24*a*, 24*b*), each mounted generally parallel to and adjacent a respective upright (12*a* and 12*b*) of said first pair (12*a*, 12*b*) and a respective upright (14*a*, 14*b*) of said second pair (14*a*, 14*b*) and being connected to generally linearly move said second pair (14*a*, 14*b*) relative to said first pair (12*a*, 12*b*); a pair of flexible tension members (30*a*, 30*b*), each connected to a respective upright (12*a* and 12*b*) of said first pair (12*a*, 12*b*) and both connected to said carriage (16); and a pair (28*a*, 28*b*) of guide structures (28*a* and 28*b*), each connected to a respective jack (24*a* and 24*b*) and being in engagement with a respective one of said tension members (30*a*, 30*b*); the improvement comprising:

means (40*a*, 40*b*) for fixedly attaching each respective one of said guide structures (28*a* and 28*b*) to a respective one of said uprights (14*a* and 14*b*) of said second pair (14*a*, 14*b*);

said uprights (14*a* and 14*b*) of said second pair (14*a*, 14*b*) being shorter than said uprights (12*a* and 12*b*) of said first pair (12*a*, 12*b*);

a pair (44*a*, 44*b*) of members (44*a* and 44*b*) generally linearly movably connected to the second pair (14*a*, 14*b*) of uprights and generally linearly movably connected to the carriage (16); and means (50) for preventing linear movement of the members (44*a* and 44*b*) relative to the second pair (44*a*, 44*b*) of uprights in response to said jacks (24*a* and 24*b*) extending beyond a selected length, said means (50) being free from interference with the generally linear movement of said carriage (16) relative to said members (44*a* and 44*b*).

3. The assembly (10) as set forth in claim 2, wherein said second uprights (14*a* and 14*b*) each have a lower end portion (56*a* and 56*b*), said first uprights (12*a* and 12*b*) each have a lower end portion (58*a* and 58*b*), said carriage (16) has a lower end portion (34), and said tension members (30*a*,30*b*) are of a length selected to substantially align said lower end portion (34) of said carriage (16) and said lower end portions(56*a* and 56*b*) of said second uprights (14*a* and 14*b*) generally with said lower end portions (58*a* and 58*b*) of said first uprights (12*a*,12*b*) in response to retraction of said jacks (24*a* and 24*b*).

4. In an extensible mast assembly (10) having a first pair (12*a*,12*b*) of generally parallel spaced apart uprights and a second pair (14*a*, 14*b*) of generally parallel spaced apart uprights, each respective upright (12*a*, 12*b*) of said first pair (12*a*, 12*b*) being positioned adjacent and mounted for generally parallel linear movement relative to a respective upright (14*a*, 14*b*) of said second pair (14*a*, 14*b*); a carriage (16) mounted for generally parallel movement relative to said first pair (12*a*, 12*b*); a pair (24*a*, 24*b*) of extensible jacks (24*a*, 24*b*), each mounted generally parallel to and adjacent a respective upright (12*a* and 12*b*) of said first pair (12*a*, 12*b*) and a respective upright (14*a*, 14*b*) of said second pair (14*a*, 14*b*) and being connected to generally linearly move said second pair (14*a*, 14*b*) relative to said first pair (12*a*, 12*b*); a pair of flexible tension members (30*a*, 30*b*), each connected to a respective upright (12*a* and 12*b*) of said first pair (12, 12*b*) and both connected to said carriage (16); and a pair (28*a*, 28*b*) of guide structures (28*a* and 28*b*), each connected to a respective jack (24*a* and 24*b*) and being in engagement with a respective one of said tension members (30*a*, 30*b*); the improvement comprising:

means (40*a*, 40*b*) for fixedly attaching each respective one of said guide structures (28*a* and 28*b*), to a respective one of said uprights (14*a* and 14*b*) of said second pair (14*a*, 14*b*);

said uprights (14*a* and 14*b*) of said second pair (14*a*, 14*b*) being shorter than said uprights (12*a* and 12*b*) of said first pair (12*a*, 12*b*);

a pair (44*a*, 44*b*) of members (44*a* and 44*b*) generally linearly movably connected to the second pair (14*a*, 14*b*) of uprights and to the carriage (16);

means (50) for preventing linear movement of the members (44*a* and 44*b*) relative to the second pair (14*a*, 14*b*) of uprights in response to said jacks (24*a* and 24*b*) extending beyond a selected length, said means (50) being free from interference with movement of said carriage (16); and means (54*a*, 54*b*) for preventing said carriage (16) from moving linearly relative to said members (44*a* and 44*b*) sufficiently to dismount said carriage (16) therefrom.

5. In an extensible assembly (10) having a first pair (12*a*,12*b*) of generally parallel spaced apart uprights (12*a* and 12*b*) and a second pair (14*a*,14*b*) of generally spaced apart uprights (14*a* and 14*b*), each respective upright (12*a* and 12*b*) of said first pair (12*a*,12*b*) being positioned adjacent and mounted for generally parallel linear movement relative to a respective upright (14*a* and 14*b*) of said second pair (14*a*,14*b*); a carriage (16) mounted for generally parallel linear movement relative to the first pair (12*a*,12*b*); a pair (24*a*,24*b*) of extensible jacks (24*a* and 24*b*), each mounted generally parallel to and adjacent a respective upright (12*a* and 12*b*) of said first pair (12*a*,12*b*) and a respective upright (14*a* and 14*b*) of said second pair (14*a*,14*b*) and being connected to generally linearly move said second pair (14*a*,14*b*) relative to said first pair (12*a*,12*b*); a pair (28*a*,28*b*) of guide structures (28*a* and 28*b*) connected to move generally linearly parallel to said uprights (12*a*,12*b*, 14*a*,14*b*) in response to extension and retraction of said jacks (24*a* and 24*b*); and a pair (30*a*,30*b*) of flexible tension members (30*a*,30*b*) each connected to a respective first upright (12*a*,12*b*) of said first pair (12*a*,12*b*), trained over a respective one of said guide structures (28*a* and 28*b*) and both connected to said carriage (16), the improvement comprising:

a pair (44*a*,44*b*) of members (44*a* and 44*b*) generally linearly movably connected to said second pair (14*a*,14*b*) of uprights and to said carriage (16) and means (50) for preventing linear movement of said members (44*a* and 44*b*) relative to said second pair (14*a*,14*b*) of uprights in response to said jacks (24*a*,24*b*) extending beyond a selected length, said means (50) being free from interference with movement of said carriage (16) relative to said member (44*a* and 44*b*).

6. In an extensible assembly (10) having a first pair (12*a*, 12*b*) of generally parallel spaced apart uprights (12*a* and 12*b*) and a second pair (14*a*, 14*b*) of generally parallel spaced apart uprights (14*a* and 14*b*), each respective upright (12*a* and 12*b*) of said first pair (12*a*, 12*b*) being positioned adjacent and mounted for generally parallel linear movement relative to a respective upright (14*a* and 14*b*) of said second pair (14*a*, 14*b*); a carriage (16) mounted for generally parallel linear movement relative to the first pair (12*a*, 12*b*); a pair (24*a*, 24*b*) of extensible jacks (24*a* and 24*b*), each mounted generally parallel to and adjacent a respective upright (12*a* and 12*b*) of said first pair (12*a*, 12*b*) and a respective upright (14*a* and 14*b*) of said second pair (14*a*, 14*b*) and being connected to generally linearly move said second pair (14*a*, 14*b*) relative to said first pair (12*a*, 12*b*); a pair (28*a*, 28*b*) of guide structures (28*a* and 28*b*) connected to move generally linearly parallel to said uprights (12*a*, 12*b*, 14*a*, 14*b*) in response to extension and retraction of said jacks (24*a* and 24*b*); and a pair (30*a*, 30*b*) of flexible tension members (30*a*, 30*b*) each connected to a respective upright (12*a*, 12*b*) of said first pair (12*a*, 12*b*), trained over a respective one of said guide structures (28*a* and 28*b*) and both connected to said carriage (16), the improvement comprising:

a pair (44*a*, 44*b*) of members (44*a*, 44*b*) generally linearly movably connected to said second pair (14*a*, 14*b*) of uprights and to said carriage (16);

means (50) for preventing linear movement of said members (44*a* and 44*b*) relative to said second pair (14*a*, 14*b*) of uprights in response to said jacks (24*a*, 24*b*) extending beyond a selected length, said means (50) being free from interference with movement of said carriage (16); and means (54*a*, 54*b*) for preventing said carriage (16) from moving linearly relative to said members (44*a* and 44*b*) sufficiently to dismount said carriage (16) from said members (44*a* and 44*b*).

* * * * *